US009685092B2

(12) United States Patent
Kurgan et al.

(10) Patent No.: US 9,685,092 B2
(45) Date of Patent: Jun. 20, 2017

(54) STATIONARY OBSTACLE IDENTIFICATION SYSTEM

(71) Applicant: HONEYWELL INTERNATIONAL INC., Morris Plains, NJ (US)

(72) Inventors: Yuriy Kurgan, Issaquah, WA (US); Kevin J. Conner, Kent, WA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 14/878,598

(22) Filed: Oct. 8, 2015

(65) Prior Publication Data

US 2017/0103662 A1 Apr. 13, 2017

(51) Int. Cl.

| | |
|---|---|
| ***G08G 5/00*** | (2006.01) |
| ***G08G 5/02*** | (2006.01) |
| ***G08G 5/06*** | (2006.01) |

(52) U.S. Cl.

CPC ..... *G08G 5/025* (2013.01); *G08G 5/065* (2013.01)

(58) Field of Classification Search

CPC .... G08G 5/0004; G08G 5/065; G08G 5/0013; G08G 5/0021; G08G 5/025; G08G 5/04; G08G 5/06

See application file for complete search history.

(56) References Cited

U.S. PATENT DOCUMENTS

| | | | | |
|---|---|---|---|---|
| 4,454,510 | A | 6/1984 | Crow | |
| 6,133,867 | A | 10/2000 | Eberwine et al. | |
| 7,965,227 | B2 | 6/2011 | Kozhevnikov et al. | |
| 8,604,965 | B2 | 12/2013 | Jennings et al. | |
| 2008/0055149 | A1 | 3/2008 | Rees et al. | |
| 2009/0018713 | A1 | 1/2009 | Coulmeau et al. | |
| 2013/0321176 | A1* | 12/2013 | Vasek | G08G 5/04 340/945 |
| 2015/0170525 | A1* | 6/2015 | Conner | G08G 5/065 701/3 |
| 2015/0193101 | A1 | 7/2015 | Mannon et al. | |
| 2015/0194060 | A1* | 7/2015 | Mannon | G08G 5/0078 701/301 |

FOREIGN PATENT DOCUMENTS

| | | |
|---|---|---|
| EP | 2431960 A2 | 3/2012 |

OTHER PUBLICATIONS

Gleim Aviation: FAR/AIM: Section 5. Surveillance Systems; Aug. 17, 2015.

EP Communication for Application No. 16192295.0-1803 dated Dec. 7, 2016.

Extended EP Search Report for Application No. 16192295.0-1803 dated Apr. 3, 2017.

* cited by examiner

*Primary Examiner* — Van Trieu

(74) *Attorney, Agent, or Firm* — Lorenz & Kopf, LLP

(57) ABSTRACT

A stationary object identification system includes memory and a transmitter. The memory has obstacle data stored therein that includes a plurality of parameters associated with each of a plurality of stationary obstacles located at a location, such as an aerodrome. The transmitter is in operable communication with the memory and is configured to generate a plurality of signals. Each of the signals is associated with a different one of the stationary obstacles and has a power level representative of the plurality of parameters associated with the stationary obstacle.

17 Claims, 2 Drawing Sheets

STATIONARY OBSTACLE IDENTIFICATION SYSTEM

TECHNICAL FIELD

The present invention generally relates to stationary obstacle avoidance, and more particularly relates to a stationary obstacle identification system.

BACKGROUND

Aircraft pilots often maneuver an aircraft while on the ground. This may happen during ground operations such as when the aircraft is taxiing, being maneuvered to or from a hangar, or to or from a terminal.

Stationary obstacles on the ground, such as buildings, fences, tethered obstacles, and various temporary obstacles, may lie in the path of the aircraft. These obstacles can be detected by the pilot via line of sight. However, in many instances, due to the dimensions of the aircraft (e.g., large wing sweep angles, distance from cockpit to wingtip) and the pilot's limited field of view, it can be difficult to monitor extremes of the aircraft during ground operations. As a result, the pilot may fail to detect obstacles that are located in "blind spots" in proximity to the aircraft. In many cases, the pilot may not detect an obstacle until it is too late to take corrective action. Low visibility due to weather or the time of day may also contribute to the pilot not detecting an obstacle. To alleviate this, many aircraft include active sensors or cameras or to sense stationary obstacles.

Collisions with a stationary obstacle can not only damage the aircraft, but can also put the aircraft out of service and result in flight cancellations. The costs associated with the repair and grounding of an aircraft can be significant. As such, the timely detection and avoidance of stationary obstacles is an important issue that needs to be addressed.

Therefore, there is a need for a system that does not rely on aircraft mounted sensors or cameras, on flight crew personnel to sense obstacles, or on separate, individual transmissions from each stationary obstacle. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a stationary object identification system includes memory and a transmitter. The memory has obstacle data stored therein that includes a plurality of parameters associated with each of a plurality of stationary obstacles located at a location. The transmitter is in operable communication with the memory and is configured to generate a plurality of signals. Each of the signals is associated with a different one of the stationary obstacles and has a power level representative of the plurality of parameters associated with the stationary obstacle.

In another embodiment, a stationary object identification system includes memory, and ADS-B transmitter, and a broadcast antenna. The memory has obstacle data stored therein that includes a plurality of parameters associated with each of a plurality of stationary obstacles located at an aerodrome. The ADS-B transmitter is in operable communication with the memory and is configured to generate a plurality of synthesized ADS-B data packets. Each synthesized ADS-B data packet is associated with a different one of the stationary obstacles and has a power level representative of the plurality of parameters associated with the stationary obstacle. The broadcast antenna is in operable communication with the transmitter to receive and transmit each of the synthesized ADS-B data packets generated by the transmitter.

In yet another embodiment, a stationary object identification system includes memory, a transmitter, a broadcast antenna, and an aircraft having a receiver disposed therein. The memory has obstacle data stored therein that includes a plurality of parameters associated with each of a plurality of stationary obstacles located at an aerodrome. The transmitter is in operable communication with the memory and is configured to generate a plurality of signals. Each of the signals is associated with a different one of the stationary obstacles and has a power level representative of the plurality of parameters associated with the stationary obstacle. The broadcast antenna is in operable communication with the transmitter to receive and transmit each of the signals generated by the transmitter. The receiver is operable, when in range of the broadcast antenna, to receive each of the signals transmitted by the antenna and is configured, upon receipt thereof, to determine at least a location of each of the stationary obstacles at the aerodrome.

Furthermore, other desirable features and characteristics of the stationary object identification system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
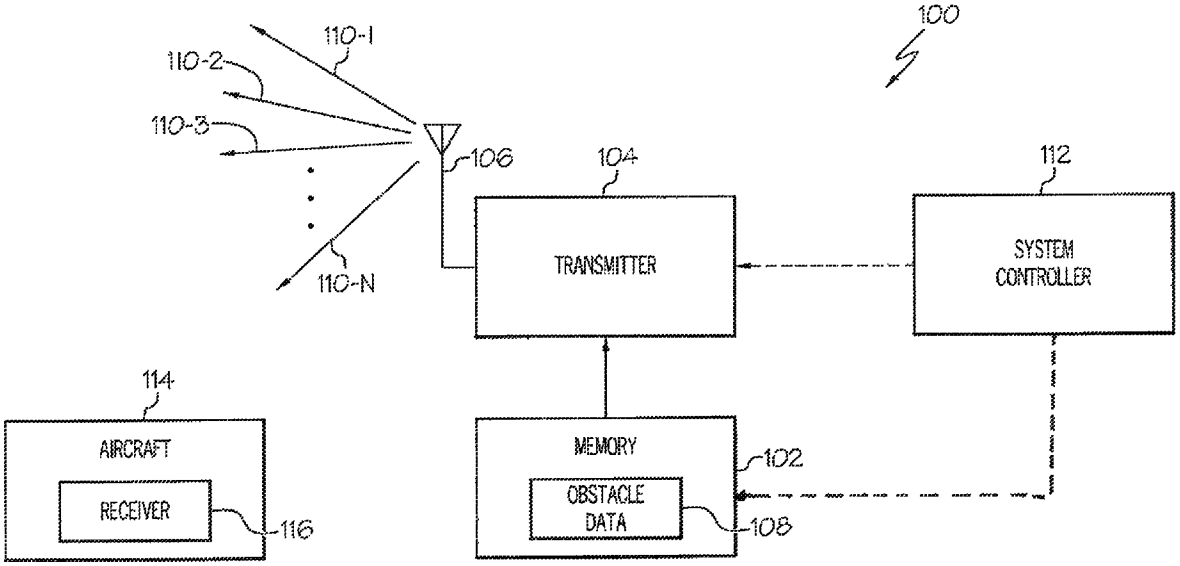
FIG. 1 depicts a functional block diagram of one embodiment of a stationary object identification system.

Referring first to FIG. 1, a functional block diagram of one embodiment of a stationary object identification system is depicted and includes a memory 102, a transmitter 104, and a broadcast antenna 106. The memory 102 may be implemented using any one of numerous types of non-transitory memory devices, and may be implemented separate from, or as part of, the transmitter 104. In the depicted embodiment, the memory 102 is implemented within the transmitter 104, and has obstacle data 108 stored therein. The obstacle data 108 includes a plurality of parameters associated with each of a plurality of stationary obstacles. In some embodiments, the stationary obstacles may be located at an aerodrome. These parameters may vary and may include one or more of the obstacle type, obstacle geometric size, obstacle altitude, and the distance from the transmitter 104 to the obstacle, just to name a few.

The transmitter 104 is in operable communication with the memory 102, and is configured to generate a plurality of signals 110 (e.g., 110-1, 110-2, 110-3 . . . 110-N) and supply the signals 110 to the broadcast antenna 106. The broadcast antenna 106, which is in operable communication with the transmitter 104, receives and transmits each of the signals 110 generated by the transmitter 104. It will be appreciated that the broadcast antenna 106 may be disposed integrally as part of the transmitter 104 or it may be disposed separate therefrom, and is preferably implemented as an omnidirectional type of antenna. Regardless, each of the signals 110 that the transmitter 104 generates is associated with a different one of the stationary obstacles. Additionally, each signal 110 is generated to have a power level that is representative of the plurality of parameters associated with the stationary obstacle. Preferably, the transmitter 104 is configured to generate each signal 110 as a data packet. In one particular embodiment, the transmitter 104 is configured as an ADS-B transmitter, and each data packet is a synthesized ADS-B packet.

As FIG. 1 also depicts, the system 100 may, at least in some embodiments, include one or more system controllers 112. Each system controller 112, if included, is disposed remote from the transmitter 104 and the memory 102. As used herein, the term remote encompasses being located at the same location or at a different location. It will be appreciated that the one or more system controllers 112 may be in operable communication with the memory 102 and/or transmitter 104 via any one of numerous wireless networks, wired networks, the Internet, or the like, or various combinations thereof.

Each system controller 112 is configured to at least selectively transmit obstacle data 108 to the memory 102. As may be appreciated, some stationary objects at an may be removed, or a location may have stationary objects added thereto. In such instances, the obstacle data 108 will preferably be updated. Such updates may be made automatically, at a set periodicity, and/or in response to a request supplied to the system controller 112 from, for example, the transmitter 104. Each system controller 112 may also be configured to run various diagnostics routines on one or more of the transmitters 104.

As may be appreciated, the signals 110 generated and transmitted by the transmitter 104 and the broadcast antenna 106 are useful for aircraft that are appropriately equipped. In particular, and as FIG. 1 further depicts, for an aircraft 114 that has a receiver 116 disposed therein that is operable, when in range of the broadcast antenna 106, to receive each of the transmitted signals 110 and is configured, upon receipt of the signals 110, to determine at least the location of each of the stationary obstacles at the aerodrome. In some embodiments, the receiver 116 may be an application specific receiver 116 for implementing this functionality. In other embodiments, such as when the transmitter 104 is configured to generate synthesized ADS-B packets, the receiver 116 may be an ADS-B receiver. As is generally known, ADS-B receivers are included in numerous aircraft, and are readily configured to receive synthesized ADS-B packets.

Figure 2:
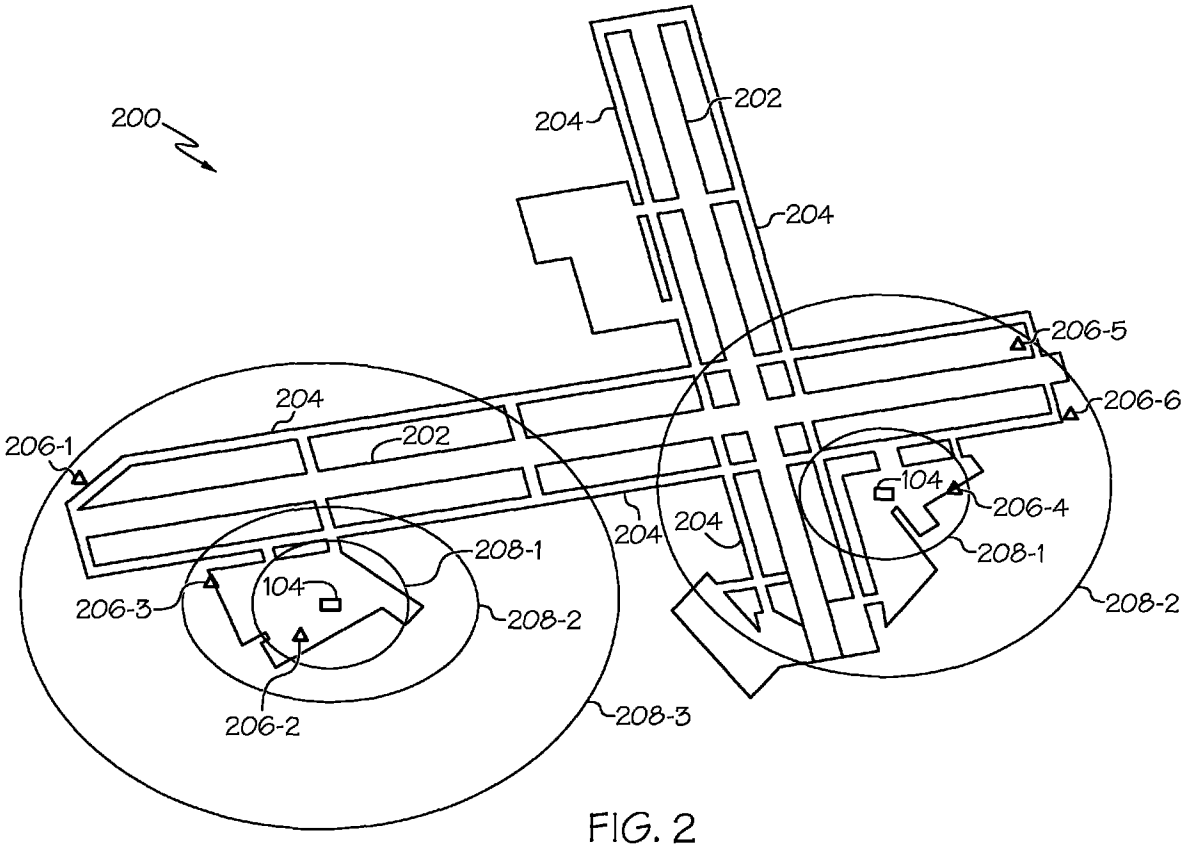
FIG. 2 depicts a representation of an overhead view of an aerodrome with markings to help illustrate the functionality of the system of FIG. 1.

To illustrate how the system described above may be implemented at one example location, such as an aerodrome, reference should be made to FIG. 2, which depicts a representation of an overhead view of an example aerodrome 200. The example aerodrome 200 includes various runways 202 and taxiways 204. The aerodrome 200 also includes various stationary obstacles, some of which are disposed near the runways 202 and taxiways 204. In the depicted aerodrome 200, these stationary obstacles include a tower 206-1, a first building 206-2, a second building 206-3, a fence 206-4, and a pair of temporary obstacles 206-5, 206-6.

It is noted that the depicted aerodrome 200 is equipped with two transmitters 104 (and thus two separate, non-illustrated memories 102, and two separate, non-illustrated broadcast antennas 106). A different subset of the stationary obstacles is associated with each of the different transmitters. It will be appreciated that this is merely exemplary of the depicted aerodrome 200 and that other aerodromes may be equipped with only a single transmitter 104 or with three or more transmitters 104, as needed or desired.

Regardless of the number of transmitters 104 at the aerodrome 200, FIG. 2 also depicts the different broadcast power 208 (e.g., 208-1, 208-2, 208-3) of each of the transmitted signals 110 (e.g., 110-1, 110-2, 110-3) generated by each transmitter 104. As noted above, the broadcast power 208 of each transmitted signal 110 varies with various parameters such as obstacle type, obstacle geometric size, obstacle altitude, and the distance from the transmitter 104 to the obstacle. This latter parameter, distance from the transmitter 104 to the obstacle, is clearly illustrated in FIG. 2. It should be noted that varying the broadcast power 208, and thereby limiting the transmission distance of the transmitted signals 110, also reduces clutter on the transmission frequency.

The system described herein provides timely detection and avoidance of stationary obstacles, and does not rely on aircraft mounted sensors or cameras, on flight crew personnel to sense obstacles, or on separate, individual transmissions from each stationary obstacle.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, i.e., memory elements, digital signal processing elements, logic elements, or look-up tables, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, i.e., a combination of a DSP and a microprocessor, a plurality of microprocessors, one or more microprocessors in conjunction with a DSP core, or any other such configuration.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A stationary object identification system, comprising:

memory having obstacle data stored therein, the obstacle data including a plurality of parameters associated with each of a plurality of stationary obstacles located at a location; and a transmitter in operable communication with the memory and configured to generate a plurality of signals, each of the signals (i) associated with a different one of the stationary obstacles and (ii) having a power level representative of the plurality of parameters associated with the stationary obstacle.

2. The system of claim 1, further comprising:

a broadcast antenna in operable communication with the transmitter to transmit each of the signals generated by the transmitter.

3. The system of claim 1, wherein the plurality of parameters include one or more of obstacle type, obstacle geometric size, obstacle altitude, and distance from the transmitter to the obstacle.

4. The system of claim 3, wherein the obstacle type includes a point type, a cluster type, and a line type.

5. The system of claim 1, wherein the transmitter is configured to transmit each signal as a data packet.

6. The system of claim 5, wherein:

the transmitter is configured as an automatic dependent surveillance-broadcast (ADS-B) transmitter; and each data packet is a synthesized ADS-B packet.

7. The system of claim 1, further comprising:

a system controller disposed remote from the transmitter and the memory, the system controller configured to at least selectively transmit the obstacle data to the memory.

8. A stationary object identification system, comprising:

memory having obstacle data stored therein, the obstacle data including a plurality of parameters associated with each of a plurality of stationary obstacles located at an aerodrome;

an automatic dependent surveillance-broadcast (ADS-B) transmitter in operable communication with the memory and configured to generate a plurality of synthesized ADS-B data packets, each synthesized ADS-B data packet (i) associated with a different one of the stationary obstacles and (ii) having a power level representative of the plurality of parameters associated with the stationary obstacle; and a broadcast antenna in operable communication with the transmitter to transmit each of the synthesized ADS-B data packets generated by the transmitter.

9. The system of claim 8, further comprising:

a system controller disposed remote from the transmitter and the memory, the system controller configured to at least selectively transmit the obstacle data to the memory.

10. The system of claim 8, wherein the plurality of parameters include one or more of obstacle type, obstacle geometric size, obstacle altitude, and distance from the transmitter to the obstacle.

11. The system of claim 10, wherein the obstacle type includes a point type, a cluster type, and a line type.

12. A stationary object identification system, comprising:

memory having obstacle data stored therein, the obstacle data including a plurality of parameters associated with each of a plurality of stationary obstacles located at an aerodrome;

a transmitter in operable communication with the memory and configured to generate a plurality of signals, each of the signals (i) associated with a different one of the stationary obstacles and (ii) having a power level representative of the plurality of parameters associated with the stationary obstacle;

a broadcast antenna in operable communication with the transmitter to receive and transmit each of the signals generated by the transmitter; and an aircraft having a receiver disposed therein, the receiver operable, when in range of the broadcast antenna, to receive each of the signals transmitted by the antenna and configured, upon receipt thereof, to determine at least a location of each of the stationary obstacles at the aerodrome.

13. The system of claim 12, wherein the plurality of parameters include one or more of obstacle type, obstacle geometric size, obstacle altitude, and distance from the transmitter to the obstacle.

14. The system of claim 13, wherein the obstacle type includes a point type, a cluster type, and a line type.

15. The system of claim 12, wherein the transmitter is configured to transmit each signal as a data packet.

16. The system of claim 15, wherein:

the transmitter is configured as an ADS-B transmitter; and each data packet is a synthesized ADS-B packet.

17. The system of claim 12, further comprising:

a system controller disposed remote from the transmitter and the memory, the system controller configured to at least selectively transmit the obstacle data to the memory.

* * * * *